US008955176B1

(12) United States Patent
Mullikin

(10) Patent No.: US 8,955,176 B1
(45) Date of Patent: Feb. 17, 2015

(54) ADJUSTABLE BED FRAME

(71) Applicant: Antonio J. Mullikin, Sebring, FL (US)

(72) Inventor: Antonio J. Mullikin, Sebring, FL (US)

( * ) Notice: Subject to any disclaimer, the term of this patent is extended or adjusted under 35 U.S.C. 154(b) by 0 days.

(21) Appl. No.: 14/313,583

(22) Filed: Jun. 24, 2014

(51) Int. Cl.
*A47C 19/04* (2006.01)

(52) U.S. Cl.
CPC ..... *A47C 19/04* (2013.01)
USPC ..... 5/183; 5/181; 5/53.1

(58) Field of Classification Search
USPC ..... 5/183, 181, 185, 53.1, 200.1, 201, 202, 5/285, 286
See application file for complete search history.

(56) References Cited

U.S. PATENT DOCUMENTS

| | | | | | |
|---|---|---|---|---|---|
| 134,359 | A | * | 12/1872 | Caro | 5/183 |
| RE5,275 | E | * | 2/1873 | Caro | 5/183 |
| 272,077 | A | * | 2/1883 | Mueller | 5/183 |
| 517,280 | A | * | 3/1894 | Karp | 5/183 |
| 1,270,414 | A | * | 6/1918 | Hoit | 5/285 |
| 1,315,170 | A | * | 9/1919 | Stefanski | 5/183 |
| 1,601,521 | A | * | 9/1926 | Frank et al. | 5/294 |
| 1,889,148 | A | * | 11/1932 | Kurkchee | 5/183 |
| 2,132,131 | A | * | 10/1938 | Schilling | 5/294 |
| 2,528,871 | A | | 11/1950 | Deuschle | |
| 4,679,261 | A | * | 7/1987 | Stanley et al. | 5/183 |
| 4,856,127 | A | | 8/1989 | Lenger | |
| 7,712,162 | B2 | | 5/2010 | Shamie et al. | |

* cited by examiner

*Primary Examiner* — Robert G Santos
(74) *Attorney, Agent, or Firm* — Crossley Patent Law

(57) ABSTRACT

An adjustable bed frame that includes a headboard, a footboard, a quartet of support posts associated with the headboard and footboard, and support frames that connect the headboard posts to the footboard posts. Both the headboard and footboard are fabricated from two equal halves that can be separated, exposing an internal leaf. Both the headboard and footboard, in conjunction with their internal leaves, can be adjusted to a variety of lengths to accommodate various-sized box springs and mattresses as needed.

6 Claims, 5 Drawing Sheets

ADJUSTABLE BED FRAME

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of adjustable bed frames are known in the prior art. However, what is needed is an adjustable bed frame that allows an individual to modify the width of the headboard and footboard in unison, allowing an individual to utilize a single bed frame for more than one sized bed depending on the needs of a particular person.

FIELD OF THE INVENTION

The present invention relates to an adjustable bed frame, and more particularly, to an adjustable bed frame that provides features and characteristics above and beyond existing devices that allow individuals to easily modify the size the width of their bed frames to accommodate more than one size of mattress with a particular bed frame.

SUMMARY OF THE INVENTION

The general purpose of the present adjustable bed frame, described subsequently in greater detail, is to provide an adjustable bed frame which has many novel features that result in an adjustable bed frame which is not anticipated, rendered obvious, suggested, or even implied by prior art, either alone or in combination thereof.

To accomplish this, the adjustable bed frame includes a headboard and a footboard, with both of these parts having left and right components. Each of these components are connected to a support post. The headboard and footboard are hollow and each contains an internal leaf which can be utilized by pulling apart the separate halves of both the headboard and footboard. The adjustable bed frame also includes a pair of support frames and side rails that allow a box spring and mattress to be properly placed atop the adjustable bed frame for regular use.

Thus has been broadly outlined the more important features of the present adjustable bed frame so that the detailed description thereof that follows may be better understood and in order that the present contribution to the art may be better appreciated.

DETAILED DESCRIPTION OF THE DRAWINGS

Figure 1:
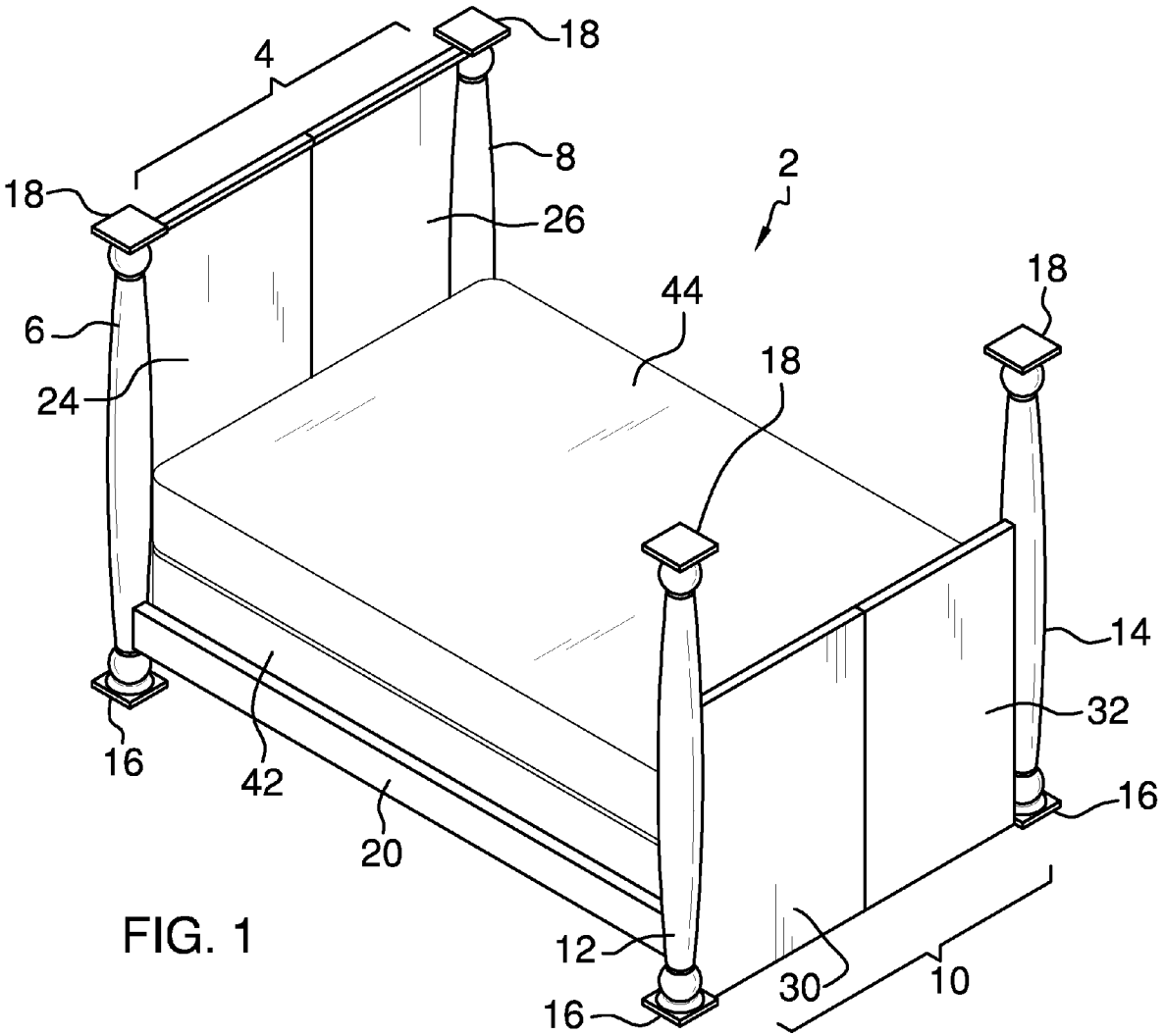
FIG. 1 is an upper perspective view of the adjustable bed frame as it would appear in use with both the headboard and footboard in a contracted position.
Figure 2:
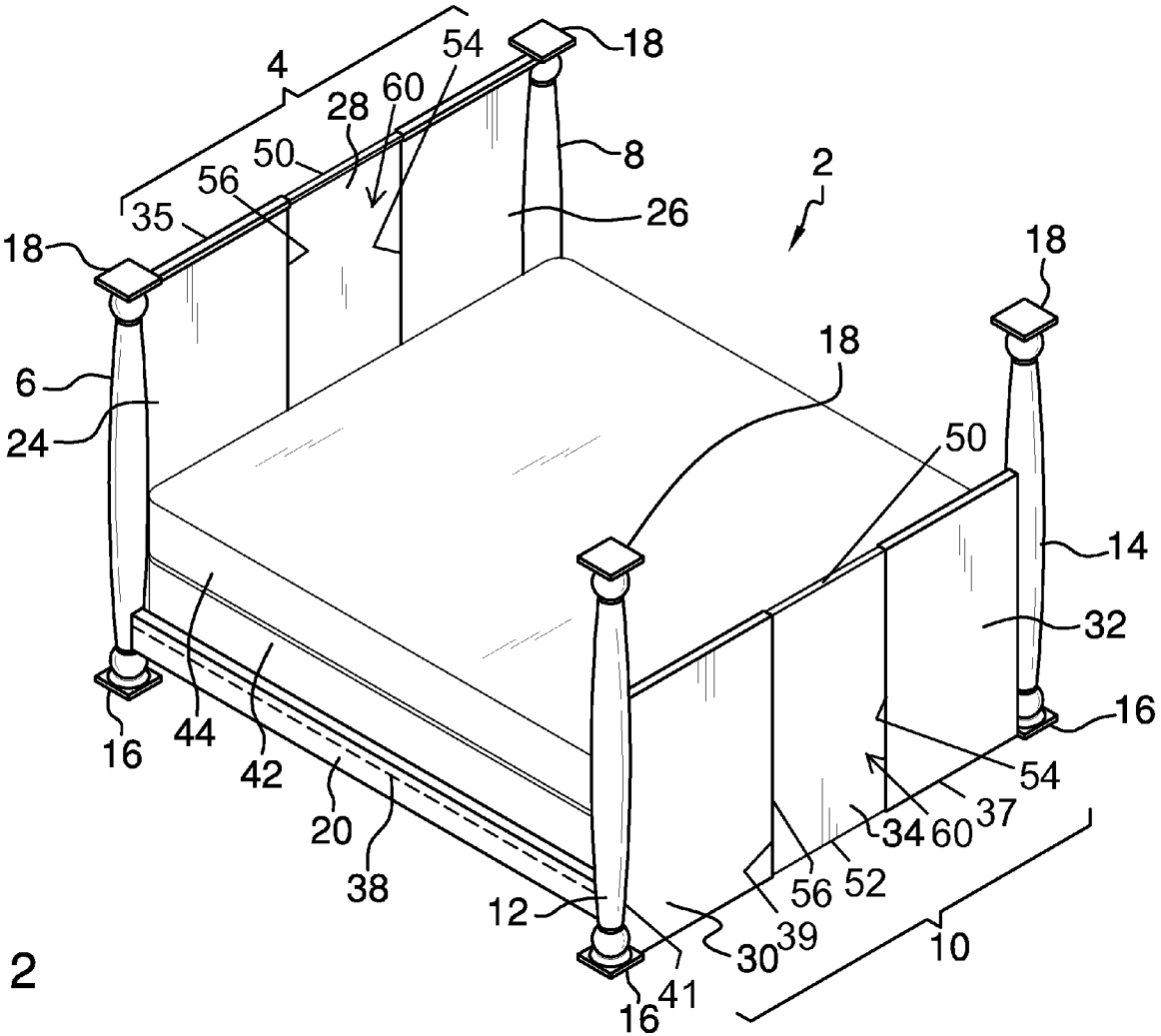
FIG. 2 is an upper perspective view of the adjustable bed frame as it would appear in use with both the headboard and footboard in an expanded position.
Figure 3:
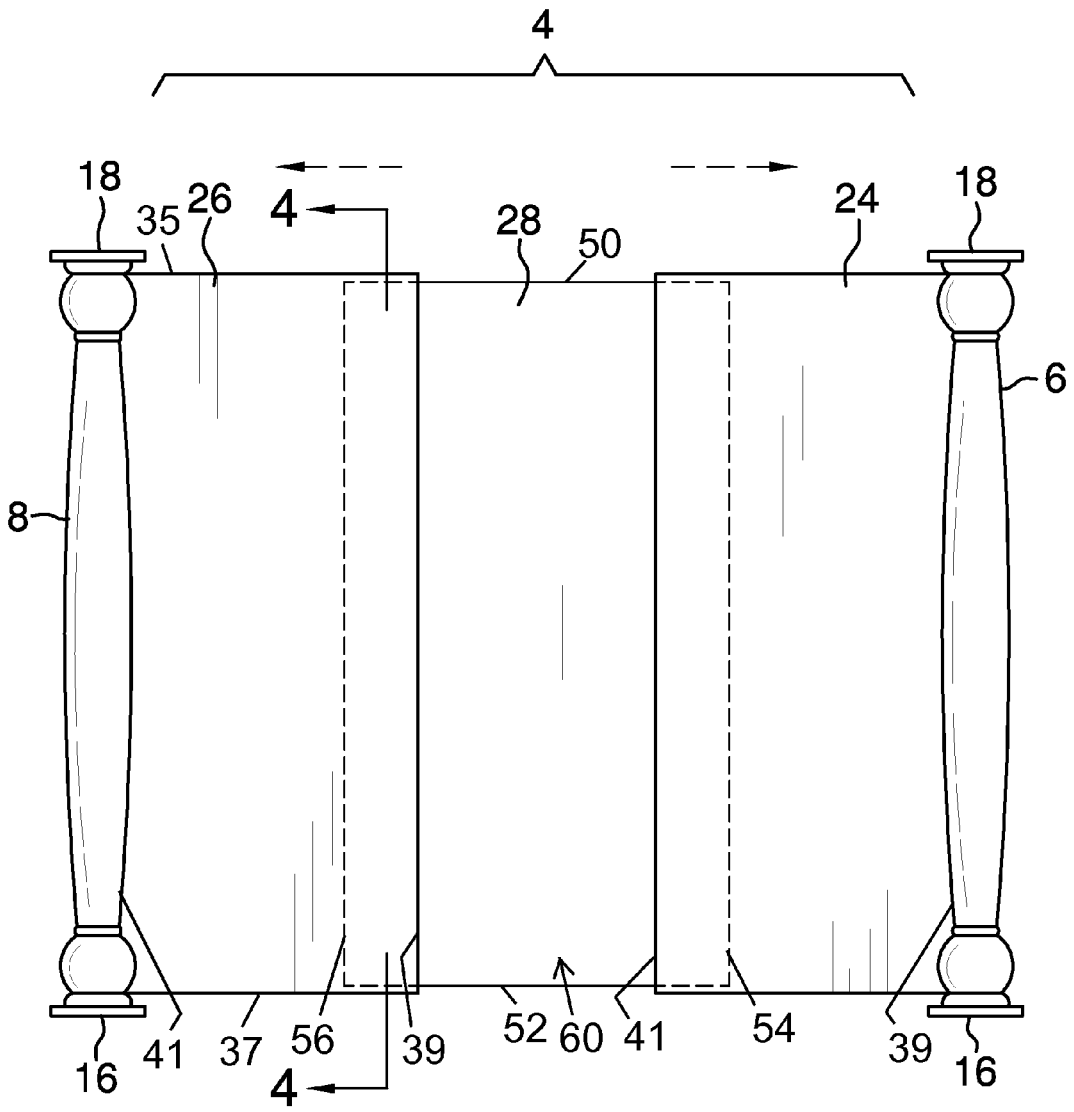
FIG. 3 is an end view of the adjustable bed frame as being viewed with the headboard closest to the observer.
Figure 4:
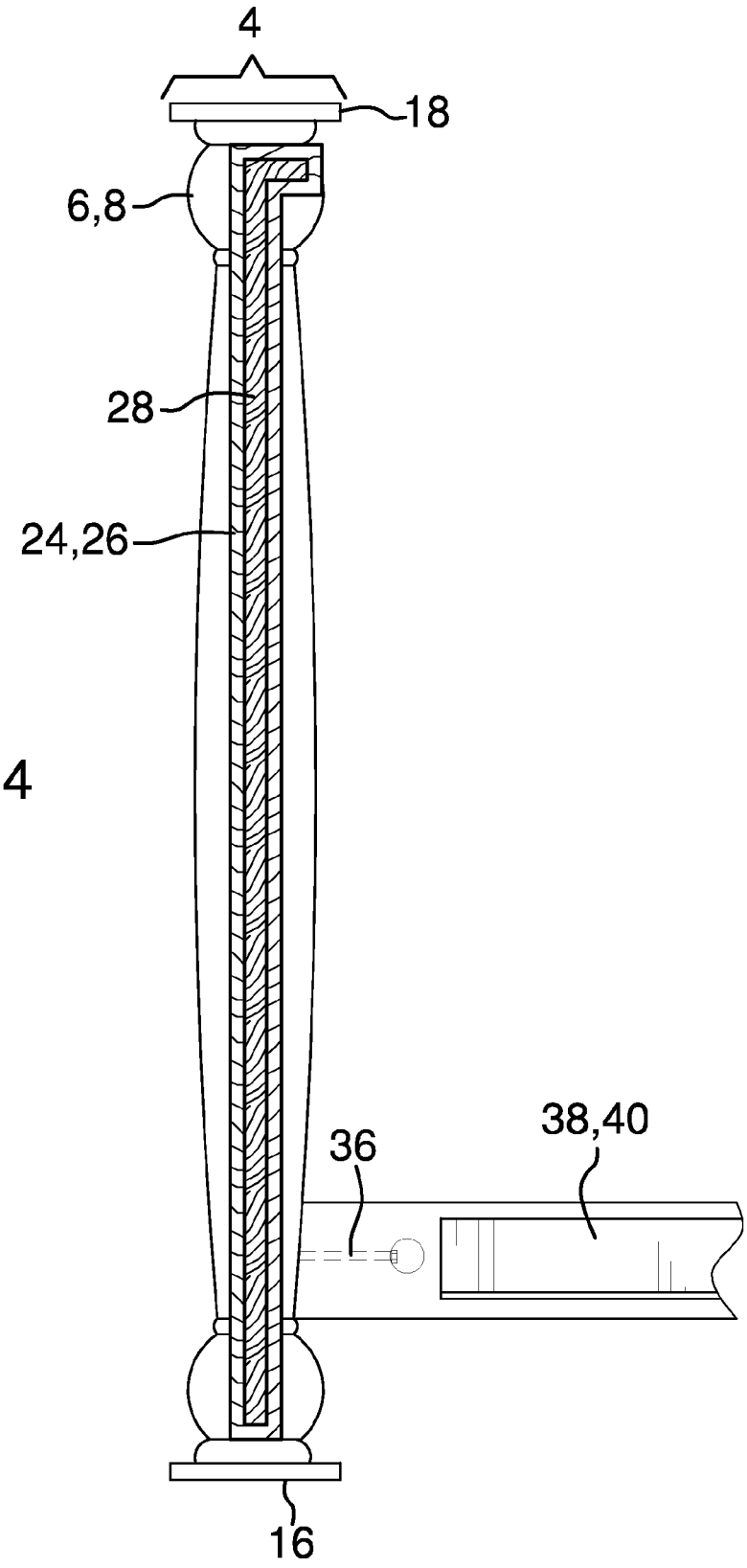
FIG. 4 is a side cutaway view of the headboard of the adjustable bed frame, highlighting the positioning of the headboard leaf within the headboard.
Figure 5:
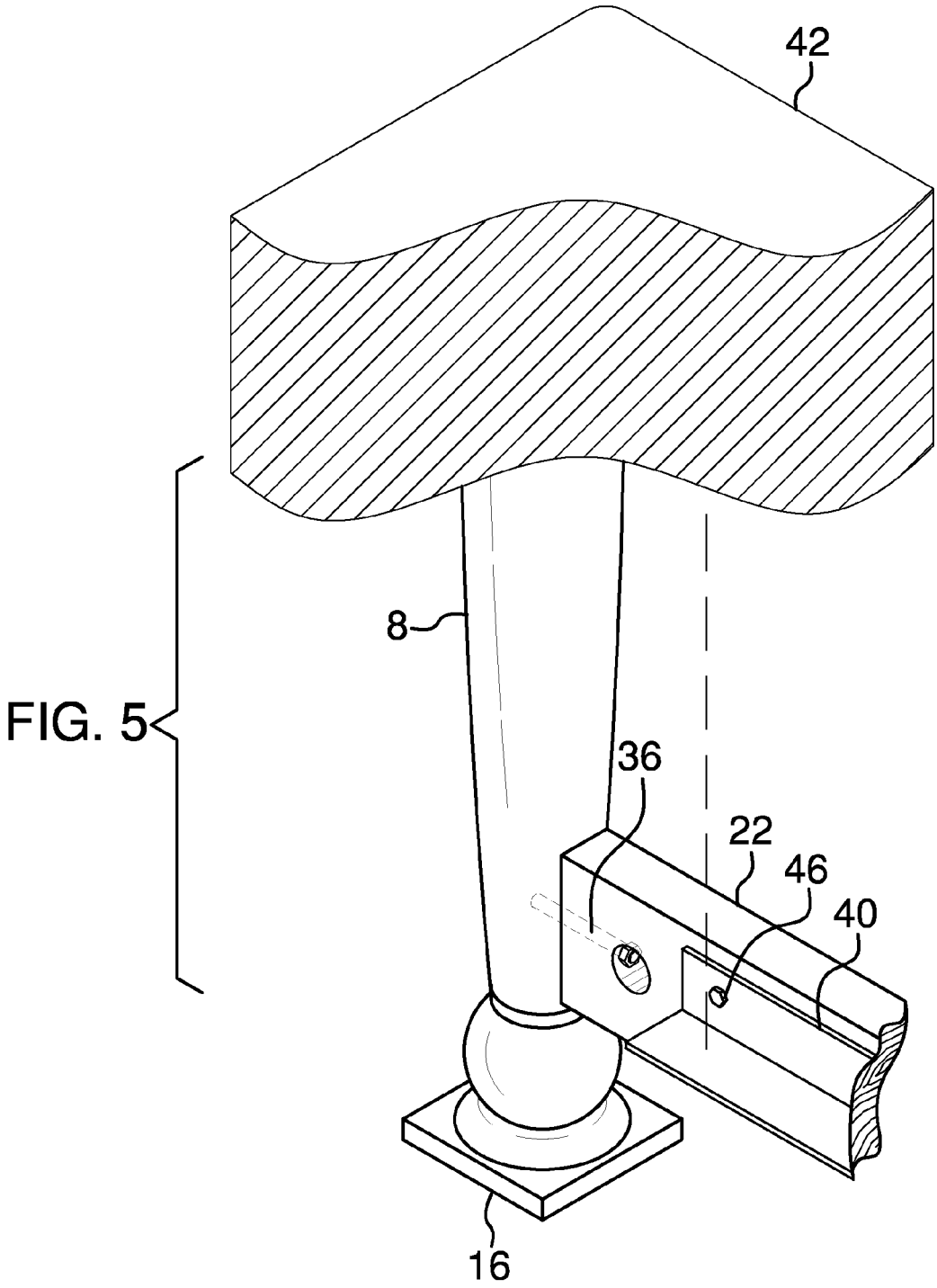
FIG. 5 shows a close-up perspective view showing the placement of the box spring in relation to a support frame and associated side rail.

With reference now to the drawings, and in particular FIGS. 1 through 5 thereof, an example of the adjustable bed frame employing the principles and concepts of the present adjustable bed frame and generally designated by the reference number 2 will be described.

Referring to FIGS. 1 through 5, a preferred embodiment of the present adjustable bed frame 2 is illustrated. The adjustable bed frame 2 includes a headboard 4 that has two attached posts comprising a left headboard post 6 and a right headboard post 8. Furthermore, adjustable bed frame 2 comprises a footboard 10 that has two posts comprising a left footboard post 12 and a right footboard post 14. Each of the posts 6, 8, 10, and 12 are supported by a base support 16 and an upper panel 18, with the base support 16 of each post providing floor support and the upper panel 18 being primarily for decoration.

Left headboard post 6 is connected to left footboard post 12 by left support frame 20, while right headboard post 8 is connected to right footboard post 14 by right support frame 22. Each connection between a post to either the headboard or a footboard is strengthened by the use of at least one screw 36.

The headboard 4 comprises two equal halves comprising a left headboard portion 24 and a right headboard portion 26. A headboard leaf 28 is insertable between the left and right headboard portions 24 and 26 and provides additional structural support to the headboard when the left and right headboard portions 24 and 26 are pulled away from one another.

The footboard 10 comprises two equal halves comprising a left footboard portion 30 and a right footboard portion 32. A footboard leaf 34 is insertable between the left and right footboard portions 30 and 32 and provides additional structural support to the footboard when the left and right footboard portions 30 and 32 are pulled away from one another. Each of the right and left headboard portions 24, 26 and each of the right and left footboard portions 30, 32 has a top end 35, a bottom end 37, a right side 39, and a left side 41. Each of the headboard leaf 28 and the footboard leaf 34 has an upper end 50, a lower end 52, a first side 54, a second side 56, and a center portion 60 continuously disposed between the upper end 50, the lower end 52, the first side 54, and the second side 56. Each of the upper end 50, the lower end 52, the first side 54, and the second side 56 of each of the headboard and footboard leaf 28, 34 is disposed directly adjacent the top end 35, the bottom end 37, the respective right and left side 39, 41 of the respective right and left headboard and footboard portions 24, 26, 30, 32 upon complete insertion and extension of the respective headboard and footboard leaf 28, 34.

When the headboard portions 24 and 26 and the footboard portions 30 and 32 are separated from one another at equal lengths, the width of the adjustable bed frame can be adjusted to accommodate various-sized mattresses. At a user's option and depending on the size of the various portions and leaves, a single adjustable bed frame 2 can be manufactured that would support two or three box spring and mattress sizes, depending on the needs of a particular individual. It would be difficult to accommodate the smallest and largest sizes on the same adjustable bed frame 2, but the present invention could easily be utilized with two or three differently-sized box spring and corresponding mattress that are similar to each in the box spring and mattress size classification scheme.

In use, a box spring 42 and mattress 44 are used in conjunction with the adjustable bed frame 2. Box spring 42 is supported by left side rail 38 and right side rail 40. Left side rail 38 is fixedly attached to the left support frame 20 by a plurality of fasteners 46, while right side rail 40 is fixedly attached to the right support frame 22 by a plurality of fasteners 46 as well. The mattress 44 would be placed atop the box spring 42 for sleeping purposes.

What is claimed is:

1. An adjustable bed frame comprising:

a headboard, the headboard comprising two portions comprising a substantially planar right headboard portion and a substantially planar left headboard portion;

a footboard, the footboard comprising two portions comprising a substantially planar right footboard portion and a substantially planar left footboard portion;

wherein each of the right and left headboard portions and each of the right and left footboard portions has a top end, a bottom end, a right side, and a left side;

a pair of headboard posts comprising a right headboard post and a left headboard post, wherein each of the headboard posts is attached to the headboard;

a pair of footboard posts comprising a right footboard post and a left footboard post, wherein each of the footboard posts is attached to the footboard;

a pair of support frames comprising a right support frame and a left support frame, wherein the right support frame is attached to the right headboard post and the right footboard post, further wherein the left support frame is attached to the left headboard post and the left footboard post;

a substantially planar headboard leaf insertable between and within the right headboard portion and the left headboard portion;

a substantially planar footboard leaf insertable between and within the right footboard portion and the left footboard portion;

wherein each of the headboard leaf and the footboard leaf has an upper end, a lower end, a first side, a second side, and a center portion continuously disposed between the upper end, the lower end, the first side, and the second side, wherein each of the upper end, the lower end, the first side, and the second side of each of the headboard and footboard leaf is disposed directly adjacent the top end, the bottom end, the respective right and left side of the respective right and left headboard and footboard portions upon complete insertion and extension of the respective headboard and footboard leaf;

a pair of side rails comprising a right side rail and a left side rail, wherein the right side rail is attached to the right support frame, further wherein the left side rail is attached to the left support frame;

wherein a box spring is placed atop the adjustable bed frame by placing the box spring on each of the side rails of the pair of side rails;

further wherein a mattress is placed atop the box spring;

further wherein an individual can adjust the length of the headboard by pulling apart the left headboard portion from the right headboard portion and utilizing whatever length of the headboard leaf as deemed necessary;

further wherein an individual can adjust the length of the footboard by pulling apart the left footboard portion from the right footboard portion and utilizing whatever length of the footboard leaf as deemed necessary.

2. An adjustable bed frame according to claim 1 wherein the adjustable bed frame further comprises:

a plurality of base supports;

wherein one base support is attached to each post associated with the adjustable bed frame, further wherein each base support provides floor support.

3. An adjustable bed frame according to claim 2 wherein the adjustable bed frame further comprises:

A plurality of upper panels;

wherein one upper panel is attached to each post associated with the adjustable bed frame.

4. An adjustable bed frame according to claim 3 wherein the adjustable bed frame further comprises:

a plurality of screws;

wherein at least one screw is used to fixedly attach the left support frame to the left headboard post;

further wherein at least one screw is used to fixedly attach the left support frame to the left footboard post;

further wherein at least one screw is used to fixedly attach the right support frame to the right headboard post;

further wherein at least one screw is used to fixedly attach the right support frame to the right footboard post.

5. An adjustable bed frame according to claim 4 wherein the adjustable bed frame further comprises:

a plurality of fasteners;

wherein some of the plurality of fasteners are used to fixedly attach the left side rail to the left support frame;

further wherein some of the plurality of fasteners are used to fixedly attach the right side rail to the right support frame.

6. An adjustable bed frame comprising:

a headboard, the headboard comprising two portions comprising a substantially planar right headboard portion and a substantially planar left headboard portion;

a footboard, the footboard comprising two portions comprising a substantially planar right footboard portion and a substantially planar left footboard portion;

wherein each of the right and left headboard portions and each of the right and left footboard portions has a top end, a bottom end, a right side, and a left side;

a pair of headboard posts comprising a right headboard post and a left headboard post, wherein each of the headboard posts is attached to the headboard;

a pair of footboard posts comprising a right footboard post and a left footboard post, wherein each of the footboard posts is attached to the footboard;

a pair of support frames comprising a right support frame and a left support frame, wherein the right support frame is attached to the right headboard post and the right footboard post, further wherein the left support frame is attached to the left headboard post and the left footboard post;

a substantially planar headboard leaf insertable between and within the right headboard portion and the left headboard portion;

a substantially planar footboard leaf insertable between and within the right footboard portion and the left footboard portion;

wherein each of the headboard leaf and the footboard leaf has an upper end, a lower end, a first side, a second side, and a center portion continuously disposed between the upper end, the lower end, the first side, and the second side, wherein each of the upper end, the lower end, the first side, and the second side of each of the headboard and footboard leaf is disposed directly adjacent the top end, the bottom end, the respective right and left side of the respective right and left headboard and footboard portions upon complete insertion and extension of the respective headboard and footboard leaf;

a pair of side rails comprising a right side rail and a left side rail, wherein the right side rail is attached to the right support frame, further wherein the left side rail is attached to the left support frame;

a plurality of base supports, wherein one base support of the plurality of base supports is attached to each post associated with the adjustable bed frame, further wherein each base support provides floor support;

a plurality of upper panels, wherein one upper panel of the plurality of upper panels is attached to each post associated with the adjustable bed frame;

a plurality of screws, wherein at least one screw is used to fixedly attach the left support frame to the left headboard post, further wherein at least one screw is used to fixedly attach the left support frame to the left footboard post, further wherein at least one screw is used to fixedly attach the right support frame to the right headboard post, further wherein at least one screw is used to fixedly attach the right support frame to the right footboard post;

a plurality of fasteners, wherein some of the plurality of fasteners are used to fixedly attach the left side rail to the left support frame, further wherein some of the plurality of fasteners are used to fixedly attach the right side rail to the right support frame;

wherein a box spring is placed atop the adjustable bed frame by placing the box spring on each of the side rails of the pair of side rails, further wherein a mattress is placed atop the box spring, further wherein an individual can adjust the length of the headboard by pulling apart the left headboard portion from the right headboard portion and utilizing whatever length of the headboard leaf as deemed necessary, further wherein an individual can adjust the length of the footboard by pulling apart the left footboard portion from the right footboard portion and utilizing whatever length of the footboard leaf as deemed necessary.

* * * * *